US005542189A

United States Patent [19]

Luton

[11] Patent Number: 5,542,189

[45] Date of Patent: Aug. 6, 1996

[54] TIMING CHAIN ADJUSTING DEVICE

[76] Inventor: Keith Luton, P.O. Box 1207, DeFuniak Springs, Fla. 32433

[21] Appl. No.: 249,469

[22] Filed: May 26, 1994

[51] Int. Cl.[6] ..... G01D 21/00

[52] U.S. Cl. ..... 33/600; 33/562

[58] Field of Search ..... 33/600, 601, 605, 33/562, 563, 533, 645, 555.2

[56] References Cited

U.S. PATENT DOCUMENTS

| | | | |
|---|---|---|---|
| 1,826,997 | 10/1931 | Dietrich | 33/601 |
| 2,821,788 | 2/1958 | Wendt | 33/600 |
| 4,353,672 | 10/1982 | Smith | 33/562 |
| 4,589,210 | 5/1986 | Konrad | 33/562 |

FOREIGN PATENT DOCUMENTS 499290 11/1919 France .

*Primary Examiner*—William A. Cuchlinski, Jr.
*Assistant Examiner*—G. Bradley Bennett
*Attorney, Agent, or Firm*—George A. Bode; Michael L. Hoelter

[57] ABSTRACT

A timing chain adjusting device that is inserted upon the crankshaft of a partially disassembled engine. The timing chain adjusting device is rotated (along with the crank shaft) to align the crank shaft in the top dead center position. Subsequently, the cam shaft is likewise rotated to be in alignment with the crank shaft and the timing chain adjusting device is installed to insure that the crank shaft gear and the cam shaft gear were properly positioned with respect to each other before the timing chain was installed.

7 Claims, 3 Drawing Sheets

TIMING CHAIN ADJUSTING DEVICE

BACKGROUND OF THE INVENTION

1. Field of the Invention

This invention pertains to a tool for internal combustion engines and more particularly to a tool used to adjust the timing chain of such engines.

2. General Background

As is well known, for an internal combustion engine to run smoothly, the rotation of the crankshaft and the camshaft must remain in synchronization. Should they fall out of synchronization, serious damage can occur to the engine.

Generally, a timing chain is employed on a crank shaft gear mounted on the crank shaft to drive a cam shaft gear mounted on the cam shaft. This timing chain thus serves the purpose of not only causing the cam shaft to rotate, but it also maintains the rotational synchronization of these two shafts. However, as is also well known, it is not uncommon for the timing chain to slip ever so much such that the two shafts are no longer fully synchronized. If the slippage is small, no serious damage to the engine will occur other than decreased performance. However, if this slippage is great, a considerable amount of damage can occur. This is because when the cam shaft is not rotated to operate the valves during the cycle exactly when the valves must be operated (which depends upon the angular rotation of the crank shaft), the engine will not operate efficiently, the engine cylinders will not fill up and exhaust as needed resulting in a substantial loss of power, and mechanical breakdown will occur.

Consequently, when correcting the slippage of a timing chain, or when otherwise overhauling or rebuilding the engine for other reasons, a simple means of aligning the two gears, and hence the shafts, is needed. Caution must be taken to prevent the timing chain from simply being inserted around the two gears without also taking into account the relative position of these two gears. For proper installation, one or both of the shafts must be manually rotated and aligned with the other before the timing chain is installed to insure that their continued rotation after the engine is assembled remains synchronized. Oftentimes, to aid in the proper synchronization of the two shafts, marks are imprinted on their respective gears that must be aligned with each other before the timing chain can be installed.

Few devices currently exist which assist the mechanic in properly orienting the gears prior to installing the timing chain. There are even fewer devices which permit the mechanic to check whether such installation has been completed properly and/or which ascertain the degree to which the two gears (and hence shafts) are out of alignment in order to determine whether they need to be re-aligned.

U.S. Pat. No. 2,522,283 issued to Lamkin pertains to a self aligning measuring gauge that can determine the throw or eccentricity of the crank pins of a crank shaft or a cam shaft. This device measures the distance between the longitudinal axis of a shaft and the outermost eccentricity of its cam.

U.S. Pat. No. 5,007,302 issued to Chen pertains to a measuring gauge that checks the alignment of a cam mounted on or disposed around a cam shaft. It's protractor-like indica and grooves which are formed both longitudinally and transverse to the axis of the shaft aid in properly aligning the cams on the shaft.

U.S. Pat. No. 4,218,939 issued to Castoe pertains to a tool used to remove the cam shaft sprocket from the cam shaft. This tool retains the alignment of the timing chain with respect to the lower crank shaft such that the engine can still be cranked even though the cylinder head is removed.

U.S. Pat. No. 4,502,233 issued to Boitz, et al., pertains to a device for checking the alignment of a shaft in a turbine-to-compressor drive mechanism.

U.S. Pat. No. 4,723,517 issued to Frost pertains to a cam drive mechanism that is driven in such a manner as to impose a variable oscillation to the cams. This has the effect of varying the period during which an associated valve is opened.

U.S. Pat. No. 5,199,182 issued to Fowler pertains to a means of aligning the shafts of adjacent drive and driven machinery in order to insure that proper angularity and parallelism has been achieved.

While each of the above mentioned devices pertain to automotive and/or engines in general, none of them aid a mechanic in obtaining the proper alignment between a crank shaft and a cam shaft. It is thus an object of this invention to provide a means of assisting a mechanic in properly installing a timing chain. Another feature of this invention is its ability to quickly ascertain whether a cam shaft is synchronized with the crank shaft or not. Still another object of this invention is to provide a tool that can be quickly and easily inserted upon the crank shaft for an immediate visual indication as to whether the crank shaft gear and the cam shaft gear are properly aligned thereby permitting the subsequent installation of the timing chain. These and other objects and advantages of this invention will become obvious upon further investigation.

SUMMARY OF THE PRESENT INVENTION

The preferred embodiment of the apparatus of the present invention solves the aforementioned problems in a straightforward and simple manner. What is disclosed is a timing chain adjusting device that is configured as an elongated planar plate of rigid or semi-rigid material. It contains a first circular opening through the plate that is located adjacent one end of the plate. This circular opening is also configured with a keyway notch therein. Additionally, this plate is configured with a second elongated opening through the plate which has a longitudinal axis that is oriented to pass through the center of the first circular opening. This second opening extends generally from a first position near or adjacent the first circular opening to a second position approaching a second opposite end of the plate.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 2:
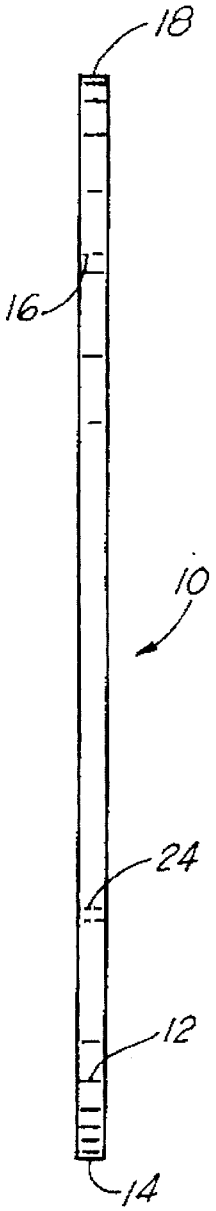
FIG. 2 is a side pictorial view of the invention illustrating its construction as a planar member.
Figure 1:
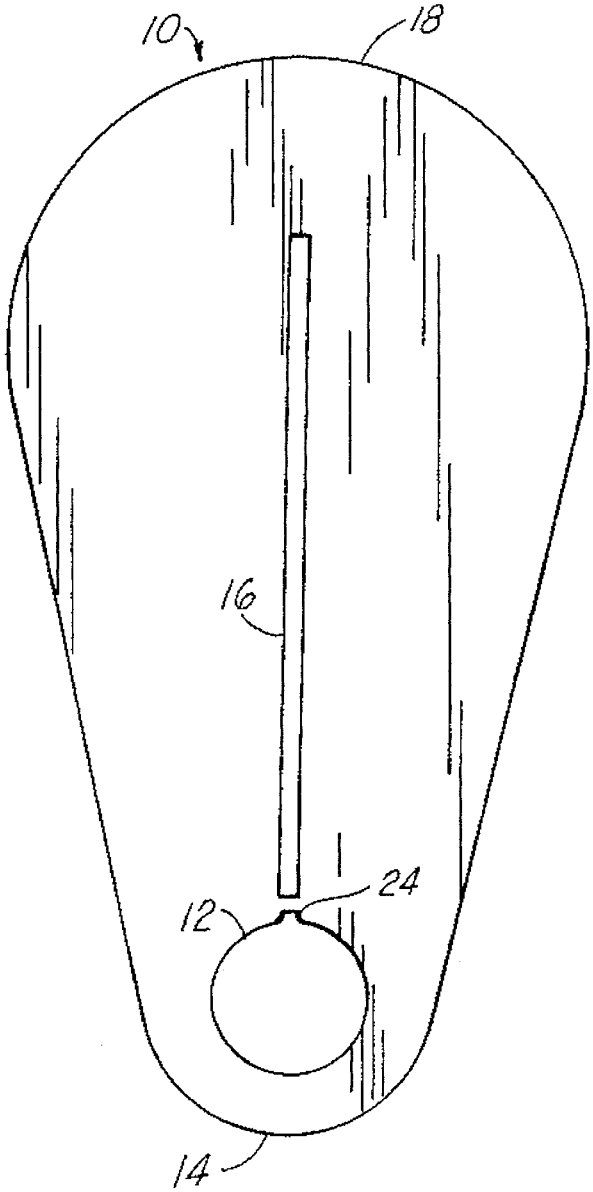
FIG. 1 is a front pictorial view of the preferred embodiment of the present invention illustrating the different openings therein.
Figure 3:
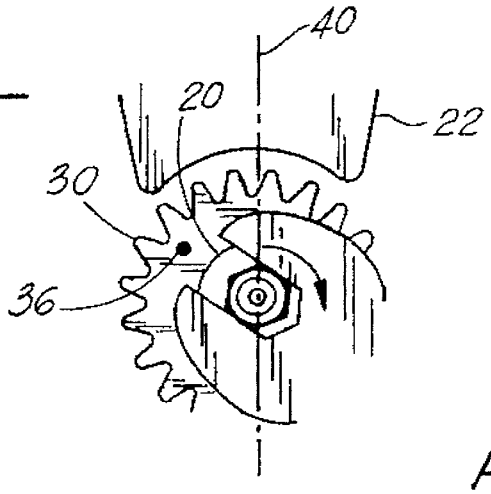
FIG. 3 is an exploded pictorial view of the operation of rotating the crank shaft of an engine so as to properly align this crank shaft.

Referring now to the drawings, and particularly FIGS. 1 and 2, there is shown timing chain adjusting device 10. This device 10 is preferably constructed of a plate of thin rigid or semi-rigid material such as metal. It is configured with a first circular opening 12 therein and adjacent end 14 and a second elongated slot 16 therein spaced from circular opening 12 and extending longitudinally toward opposite end 18. The position of this elongated slot 16 is such that its longitudinal axis passes through the center of circular opening 12. Thus, slot 16 can be said to extend radially outwardly from opening 12.

Figure 4:
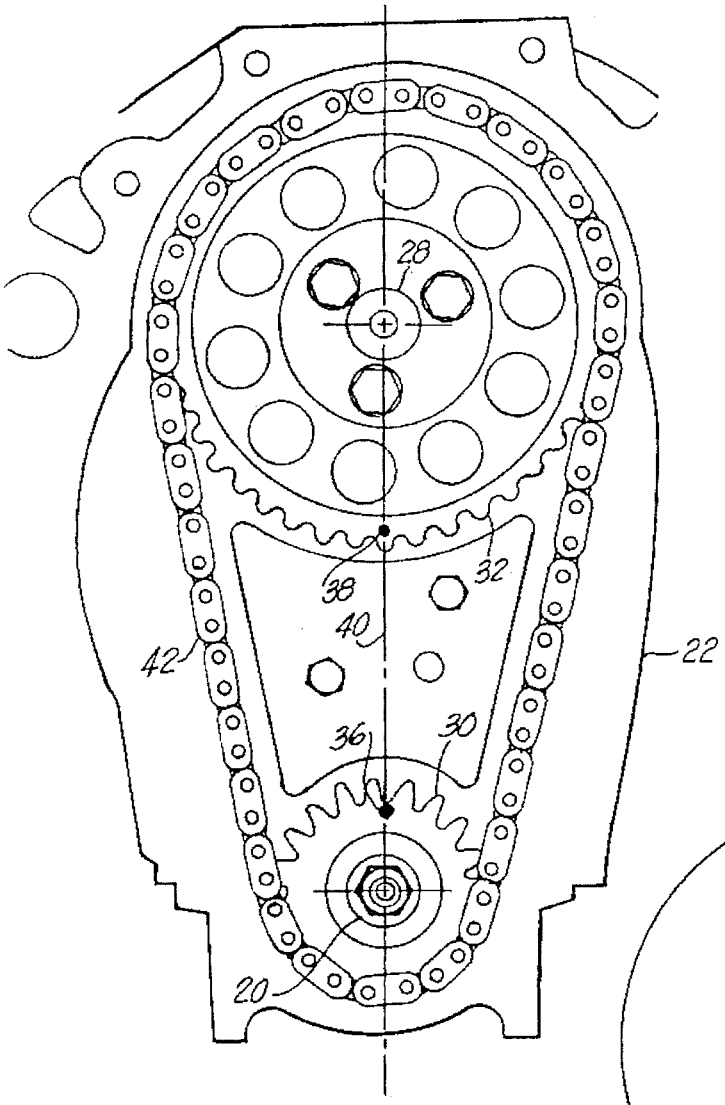
FIG. 4 is a pictorial view of a partially disassembled engine illustrating the crank shaft, cam shaft, crank shaft gear, cam shaft gear, and timing chain.

Circular opening 12 is sized to snugly fit around a lower crank shaft 20 of a disassembled engine 22 as best seen in FIG. 4. To insure the proper placement of device 10 on crank shaft 20, circular opening 12 is also configured with a notch or keyway 24 at its perimeter that is sized to snugly fit key 26 on crank shaft 20. Consequently, when device 10 is installed on crank shaft 20, both device 10 and crank shaft 20 will rotate in unison.

As can be imagined, should different engines 22 have differently sized crankshafts 20 or differently sized keys 26, then differently sized devices 10 will be required for each of these different engines 22. However, it is possible for device 10 to be manufactured with a single sized opening 27 that can accommodate a series of differently sized notched bushings 44 which are inserted within opening 27. These differently sized bushings 44 can be retained within opening 27 by enlarged edge 29 of bushing 44. In this fashion, only one device 10 will be required with the user then only needing to acquire the particular notched bushing 44 for the particular engine being repaired.

Figure 5:
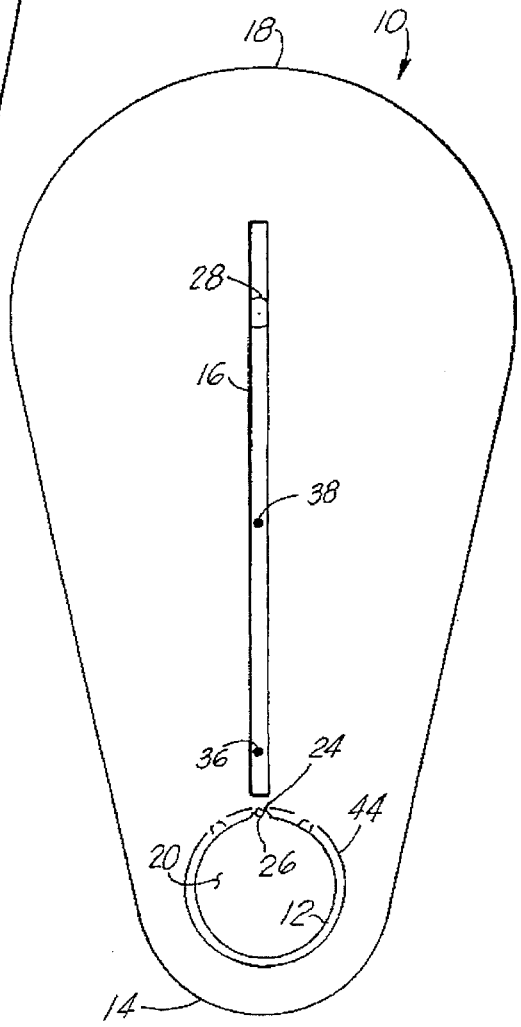
FIG. 5 is a pictorial view of the embodiment of FIG. 1 inserted upon the engine with the marks of the respective gears showing through the elongated slot.

When device 10 is thusly installed and rotated to a generally vertical position, as best seen in FIG. 5, a portion of upper cam shaft 28 will be viewable through elongated slot 16. When the center of upper cam shaft 28 is visible through slot 16, the user will then know that device 10, and hence crank shaft 20, is in the desired or proper position for subsequent alignment between this crank shaft 20 and upper cam shaft 28.

In order to align or synchronize shafts 20 and 28, their respective gears, crank shaft gear 30 and cam shaft gear 32, would typically first be removed from engine 22. It should also be noted that crank shaft gear 30 is generally configured with a first mark 36 adjacent its gear teeth while cam shaft gear 32 is configured with a second mark 38 adjacent its gear teeth. The two marks, 36 and 38, are used to properly align cam shaft gear 32 with respect to crank shaft gear 30.

After crank shaft 20 is properly positioned as stated above, timing chain adjusting device 10 is removed and crank shaft gear 30 is re-installed in such a manner that its mark 36 is in a vertical up position and also co-linear with a line or axis 40 passing through the center of crank shaft 20 and cam shaft 28. To complete the alignment process, upper cam shaft 28 must be rotated so that its respective mark 38 is located adjacent mark 36 on crank shaft gear 32 which would also be co-linear with line or axis 40 (FIG. 4). When these two marks 36 and 38 are thusly positioned, device 10 is re-installed upon crank shaft 20 to insure that marks 36 and 38, and also the center of upper cam shaft 28, are visible through slot 16 (FIG. 5). When this occurs, gears 30 and 32, and hence shafts 20 and 28, are properly aligned. Consequently, timing chain 42 can now be installed with confidence knowing that the two gears 30 and 32, and hence shafts 20 and 28, are properly aligned. Of course, before actually installing timing chain 42, device 10 needs to be removed so as to provide sufficient room for the installation of timing chain 42.

The outside perimeter of device 10 is illustrated as preferably being somewhat pear-shaped in FIGS. 1 and 5. However, this shape is not important and, in fact, any other shape will suffice. What is important are circular opening 12 and radially oriented elongated slot 16 in device 10.

Figure 6:
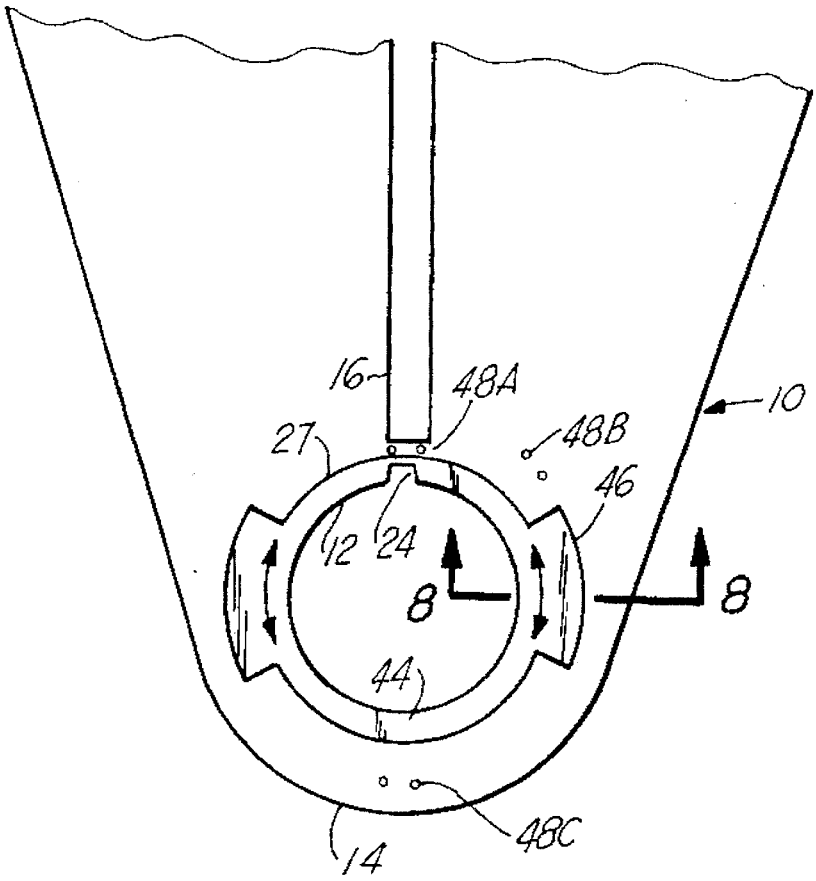
FIG. 6 is a front pictorial view of an alternate embodiment of the present invention.
Figure 8:
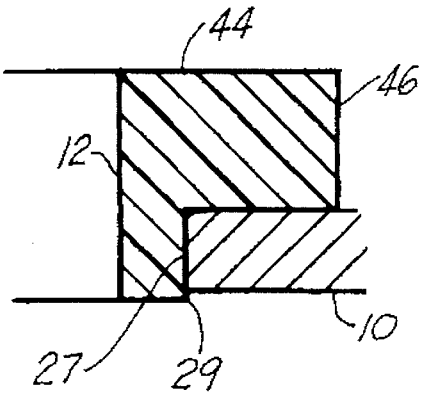
FIG. 8 is a cross-sectional view taken along Lines 8—8 of FIG. 6.
Figure 7:
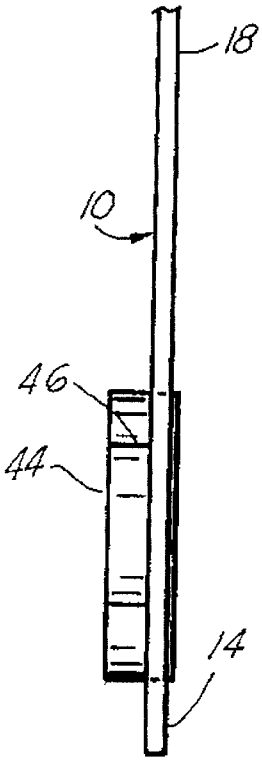
FIG. 7 is a side pictorial view of the embodiment of FIG. 6.

Additionally, opening 12 can be configured with a rotatable ring or bushing 44 therein best seen in the alternate embodiment illustrated in FIGS. 6–8. As stated earlier, this ring or bushing 44 is held in place by enlarged edge 29 or by some other such means. In this case, ring 44 is configured with keyway 24 such that the position of keyway 24 with respect to device 10 can be varied. This can be accomplished by simply rotating ring 44 (and hence keyway 24) about opening 12 by using tab 46. Consequently, one device 10 can be utilized on a variety of different crank shafts 20 whose keys 26 are located at different positions about crank shaft 20. Thus, only one device 10 need be employed for that particular crank shaft 20 size regardless of the position or location of its corresponding key 26. Of course, the use of device 10 would be the same with the additional step of insuring that device 10 is properly aligned with respect to key 26. A series of indicia or other marks 48 on device 10 can be utilized for this. In this embodiment, marks 48A pertain to Ford engines, marks 48B pertain to Chrysler, some General Motors, and Jeep engines, while marks 48C pertain to other General Motors engines. Different or additional marks 48 for other engines or purposes can also be applied to device 10. Furthermore, different marks 48 on device 10 can be designed and utilized for such purposes as indicating angular degrees so that it can be ascertained how far out of alignment the two gears 30 and 32 are.

The following steps are typically followed for proper installation of timing chain 42 utilizing device 10. First, engine 22 is disassembled to the point where crank shaft 20 and cam shaft 28 are accessible. Second, timing chain 42 and both crank shaft gear 30 and cam shaft gear 32 are removed from engine 22. Third, device 10 is inserted over key 26 on crank shaft 20 and both are rotated until the center of cam shaft 28 is visible through slot 16. Crank shaft 20 is now positioned with valve number one (not shown) in the top dead center position and no further movement of crank shaft 20 is permitted until after timing chain 42 is installed. Fourth, device 10 is removed and crank shaft gear 30 is re-inserted upon crank shaft 20 with first mark 36 on crank shaft gear 30 being placed in a vertically up and co-linear position with respect to the center of shafts 20 and 28 (see line 40 of FIG. 4). Fifth, cam shaft gear 32 is re-installed upon cam shaft 28 and rotated so that its respective mark 38 is located in a vertically down position adjacent crank shaft mark 36 and also in a co-linear position with respect to the center of shafts 20 and 28 (see line 40 of FIG. 4). The two gears 30 and 32, and hence shafts 20 and 28, are now properly aligned with respect to each other. Sixth, device 10 is re-installed upon crank shaft 20 and over key 26 (FIG. 5). Slot 16 should now permit a view of the center of cam shaft 28 since crank shaft 20 was not moved or rotated since being properly positioned in step three above. Additionally, marks 36 and 38 should also be visible through slot 16 intermediate shafts 20 and 28. If not, then gears 30 and 32 and/or shafts 20 and 28 will need to be re-aligned. Seventh, device 10 is removed and timing chain 42 is installed without altering the orientation of gears 30 and 32.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A timing chain adjusting device comprising:

(a) an elongated planar plate of rigid or semi-rigid material, said plate being of lesser lateral extent at its first end portion than at the other or second end portion;

(b) a first circular opening within said plate and adjacent said first end portion of said plate, said circular opening being configured with a keyway notch provided at the perimeter thereof;

(c) a second elongated narrow opening within said plate having a longitudinal axis oriented to pass through the center of said first circular opening, said second elongated opening extending generally longitudinally from a first position near to said notch provided at the perimeter of said first circular opening to a second position approaching said second end portion of said plate, said keyway notch of said first opening being located in said perimeter of said first opening in alignment with said longitudinal axis of said second opening; and, (d) a rotatable ring secured about the circumference of said first circular opening, said rotatable ring having a keyway notch at its perimeter for alignment with said keyway notch in said first circular opening.

2. The apparatus as set forth in claim 1, wherein said rotatable ring comprises: means for rotating said ring about said first circular opening, and hence said keyway notch thereat, with respect to said elongated planar plate.

3. The apparatus as set forth in claim 2, further comprising: marking or indica means on said first end portion of said plate for properly aligning said keyway notches of said circular opening and rotatable ring therewith.

4. A timing chain adjusting device comprising:

(a) an elongated planar unitary plate of rigid or semi-rigid material, said plate being of lesser lateral extent at its first end portion than at the other or second end portion;

(b) a first circular opening within said plate and adjacent said first end portion of said plate, said circular opening being configured with a keyway notch provided at the perimeter thereof functioning as a means for locating the device on the crank shaft of an engine;

(c) a second elongated narrow opening within said plate having a longitudinal axis oriented to pass through the center of said first circular opening, said second elongated opening extending generally longitudinally from a first position near to said notch provided at the perimeter of said first circular opening to a second position approaching said second end portion of said plate, said second opening functioning as a means for locating the device on the cam shaft of said engine, said keyway notch of said first opening being located in said perimeter of said first opening in alignment with said longitudinal axis of said second opening; and, (d) a rotatable ring secured about the circumference of said first circular opening, said rotatable ring having a keyway notch at its perimeter for alignment with said keyway notch in said first circular opening.

5. The apparatus as set forth in claim 4, wherein said rotatable ring comprises: means for rotating said ring about said first circular opening, and hence said keyway notch thereof, with respect to said elongated planar plate.

6. The apparatus as set forth in claim 5, further comprising: marking or indica means on said first end portion of said plate for properly aligning said keyway notches of said circular opening and rotatable ring therewith.

7. The method of adjusting a timing chain on an engine having its crank shaft, cam shaft, crank shaft gear, cam shaft gear, and timing chain exposed and accessible, comprising the steps of:

(a) removing the crank shaft gear, cam shaft gear, and timing chain from the engine;

(b) inserting a timing chain adjusting device around the crank shaft, said timing chain adjusting device comprising an elongated planar plate having a first circular opening therein adjacent one end of said plate and sized to accept the crank shaft therein, said first opening of said timing chain adjusting device having a keyway notch provided at its perimeter sized to accept therein the key on the crank shaft; and a second elongated narrow opening extending generally longitudinally from a first position near to said notch of said first circular opening to a second position approaching a second or opposite end of said plate;

(c) securing a rotatable ring about the circumference of said first circular opening, said rotatable ring incorporating a keyway therein, said ring having means for rotating said ring, and hence said keyway, with respect to said plate for alignment with said keyway notch in said first circular opening;

(d) rotating said plate, and hence the crank shaft, so that the center of the cam shaft is visible through said second elongated opening and said keyway in said first opening is aligned with the longitudinal axis of said second opening;

(e) providing marking or indica means on said plate for properly aligning said keyway therewith;

(f) removing said timing chain adjusting device from the crank shaft and re-installing the crank shaft gear upon said crank shaft, whereby the crank shaft gear is re-installed with a first mark thereon being located in a vertically up position co-linear with a line passing through the centers of both the crank shaft and the cam shaft;

(g) re-installing the cam shaft gear upon the cam shaft, the cam shaft gear being re-installed with a second mark thereon being located in a vertically down position adjacent said first mark and also co-linear with said line;

(h) re-installing said timing chain adjusting device upon the crank shaft to insure that said first and second marks and the center of the cam shaft are each visible through said second elongated opening; and, (i) removing said timing chain adjusting device from the crank shaft and installing the timing chain upon the crank shaft gear and the cam shaft gear without further rotation of either gear.

* * * * *